US007277856B2

(12) United States Patent
Lee et al.

(10) Patent No.: US 7,277,856 B2
(45) Date of Patent: Oct. 2, 2007

(54) SYSTEM AND METHOD FOR SPEECH SYNTHESIS USING A SMOOTHING FILTER

(75) Inventors: Ki-seung Lee, Seoul (KR); Jeong-su Kim, Kyungki-do (KR); Jae-won Lee, Seoul (KR)

(73) Assignee: Samsung Electronics Co., Ltd., Suwon, Kyungki-do (KR)

( * ) Notice: Subject to any disclaimer, the term of this patent is extended or adjusted under 35 U.S.C. 154(b) by 905 days.

(21) Appl. No.: 10/284,189

(22) Filed: Oct. 31, 2002

(65) Prior Publication Data

US 2003/0083878 A1 May 1, 2003

(30) Foreign Application Priority Data

Oct. 31, 2001 (KR) ..... 2001-67623

(51) Int. Cl.
*G10L 13/00* (2006.01)

(52) U.S. Cl. ..... 704/266

(58) Field of Classification Search ..... None
See application file for complete search history.

(56) References Cited

U.S. PATENT DOCUMENTS 5,636,325 A * 6/1997 Farrett ..... 704/258
6,078,885 A * 6/2000 Beutnagel ..... 704/258
6,175,821 B1 * 1/2001 Page et al. ..... 704/258
6,304,846 B1 * 10/2001 George et al. ..... 704/270
6,366,883 B1 * 4/2002 Campbell et al. ..... 704/260
6,665,641 B1 * 12/2003 Coorman et al. ..... 704/260
2002/0099547 A1 * 7/2002 Chu et al. ..... 704/260

OTHER PUBLICATIONS

European Search Report issued by the European Patent Office on Jan. 13, 2005 in a corresponding application.
Johan Wouters et al., "Control of Spectral Dynamics in Concatenative Speech Synthesis," IEEE Transactions on Speech and Audio Processing, New York, US, vol. 9, No. 1, Jan. 2001, pp. 30-38.

(Continued)

*Primary Examiner*—Abul K. Azad
(74) *Attorney, Agent, or Firm*—Buchanan Ingersoll & Rooney PC

(57) ABSTRACT

A speech synthesis system for controlling a discontinuous distortion that occurs at the transition portion between concatenated phonemes which are speech units of a synthesized speech using a smoothing technique, comprising: a discontinuous distortion processing means adapted to predict a discontinuity at the transition portion between concatenated samples of phonemes used for a speech synthesis through a predetermined learning process, and control a discontinuity at the transition portion between the concatenated phonemes of the synthesized speech in such a fashion that it is smoothed adaptively to correspond to a degree of the predicted discontinuity. The smoothing filter smoothes the synthesized speech so that the discontinuity degree of synthesized speech follows the predicted discontinuity degree according to the filter coefficient (a) changed adaptively to correspond to a ratio of the predicted discontinuity degree to the real discontinuity degree. That is, since a discontinuity at a transition portion between concatenated phonemes of the synthesized speech (IN) is adaptively smoothed to follow that which occurs in the actually spoken sound, the synthesized speech (IN) can be approximated more closely to a real human voice.

18 Claims, 2 Drawing Sheets

OTHER PUBLICATIONS

Takashi Yazu et al., "The Speech Synthesis System for an Unlimited Japanese Vocabulary," International Conference on Acoustics, Speech & Signal Processing, ICASSP, Tokyo, Apr. 7-11, 1986, New York, US, vol. 3, Conf. 11, pp. 2019-2022.

Alan W. Black et al., "Automatically Clustering Similar Units for Unit Selection in Speech Synthesis," 5th European Conference on Speech Communication and Technology, Rhodes, Greece, Sep. 22-25, 1997, vol. 2 of 5, pp. 601-604.

N. Yiourgalis et al., "A TtS system for the Greek language based on concatenation of formant coded segments," Speech Communication, Elsevier Science Publishers, Amsterdam, NL, vol. 19, No. 1, Jul. 1996, pp. 21-38.

M. Plumpe et al., "HMM-Based Smoothing for Concatenative Speech Synthesis," Conference Proceedings Article, Oct. 1998, pp. P908-P911.

Fu-Chiang Chou et al., "Corpus-Based Mandarin Speech Synthesis with Contextual Syllabic Units Based on Phonetic Properties," Acoustics, Speech and Signal Processing, Proceedings of the 1998 IEEE International Conference on Seattle, WA, USA, May 12-15, 1998, New York, NY, USA.

Chen, Stanley F., "*A Survey of Smoothing Techniques for ME Models*," 8 IEEE Transactions on Speech and Audio Processing, pp. 37-50 vol. 8, No. 1, Jan. 2000.

* cited by examiner

| ALGORITHM | DISTORTION IN NATURALNESS | DISTORTION IN INTELLIGIBILITY |
|---|---|---|
| NO SMOOTHING | 2.75 | 2.66 |
| WI-BASED | 3.09 | 3.22 |
| LP-POLE TRANSITION | 3.75 | 3.53 |
| CONTINUITY EFFECTS | 4.41 | 4.34 |

SYSTEM AND METHOD FOR SPEECH SYNTHESIS USING A SMOOTHING FILTER

BACKGROUND OF THE DISCLOSURE

This application claims the priority of Korean Patent Application No. 2001-67623, filed Oct. 31, 2001, in the Korean Intellectual Property Office, the disclosure of which is incorporated herein in its entirety by reference.

1. Field of the Disclosure

The present invention relates to a speech synthesis system, and more particularly, to a system and method for synthesizing speech in which a smoothing technique is applied to the transition portion between concatenated speech units of the synthesized speech, thereby preventing a discontinuous distortion at the transition portion.

2. Description of the Related Art

In general, a Text-to-Speech (hereinafter, referred to as "TTS") system refers to a type of speech synthesis system in which a user enters a text, optionally in a computer document, to automatically create a speech or a spoken sound version of the text using a computer, etc., so that the contents of the text thereof can be read aloud to other users. Such a TTS system is widely used in an application field such as an automatic information system (AIS), which is one of key technologies for implementing conversation of a human being with a machine. This TTS system has been used to create a synthesized speech closer to a human speech since a corpus-based TTS was introduced. The corpus-based TTS is based on a large capacity data base in the 1990s. Further, an improvement in the performance of a prosody prediction method to which a data-driven technique is applied results in a creation of more animated speech.

However, despite this technological development, there has been a problem in that a discontinuity occurs at the transition portion between the concatenated speech units of synthesized speech. A speech synthesis system basically concatenates respective small speech segments according to a row of speech units as phonemes to form a complete speech signal so as to produce a concatenative spoken sound. Accordingly, when adjacent speech segments have different characteristics, there may occur a distortion during hearing of an output speech. Such a hearing distortion may be represented in a form of a trembling of the speech due to rapid fluctuations and discontinuity in spectrums, an unnatural change of prosody (i.e., the pitch and duration) of the speech unit, and an alteration in the size of a waveform of the speech.

In the meantime, two methods are used to remove a discontinuity that occurs at the transition portion between the concatenated speech units of a synthesized speech. For a first method, a difference in the characteristics between the speech units to be concatenated is previously measured during the selection of speech units, and then the speech units are selected in such a fashion that the difference is minimized. For a second one, a smoothing technique is applied to the transition portion between concatenated speech units of a synthesized speech.

Steady research has been conducted for the first method, and recently, a minimization technique of a discontinuous distortion reflecting the characteristic of an ear has been developed, which is successfully applied to the TTS. On the other hand, research has not been actively conducted for the second method compared with the first method. The reason for this is that the smoothing technique is regarded as a more important factor in speech coding technology than in speech synthesis based on a signal processing technology, and that the smoothing technique itself may cause a distortion in speech signals.

Recently, a smoothing method applied to a speech synthesizer generally uses a method used in a speech coding.

FIG. 1 is a table illustrating the results for distortions in terms of both naturalness and intelligibility when various smoothing methods applicable to a speech coding are applied to a speech synthesis, wherein the applied smoothing methods include WI-base method, LP-pole method and continuity effects method.

Referring to FIG. 1, it can be found that distortion values in naturalness and intelligibility are smaller when not applying a smoothing method (i.e., no smoothing) than when applying various smoothing methods, resulting in exhibition of a superior speech quality incase of no smoothing (see CHEN, Stanley F., "*A Survey of Smoothing Techniques for ME Models,*" 8 *IEEE TRANSACTIONS ON SPEECH AND AUDIO PROCESSING,* pp. 37-50 Vol. 8, No. 1, January 2000. Consequently, it can be seen that since the case of not applying a smoothing method to a speech synthesis is more effective than that of applying the smoothing method to that, it is inappropriate to apply the smooth method applied to a speech coder to the speech synthesizer.

A distortion largely occurs owing to a quantization error, etc., in the speech coder. At this time, a smoothing method is also used to minimize the quantization error, etc. However, since a recorded speech signal itself is used in the speech synthesizer, there does not exist the quantization error as in the speech coder. The distortion occurs due to the erroneous selection of speech units, or rapid fluctuations and discontinuity in spectrums between speech units. That is, since the speech coder and the speech synthesizer are different from each other in terms of the cause of inducing a distortion, the smoothing method applied to the speech coder is not effective in the speech synthesizer.

SUMMARY OF THE DISCLOSURE

In an effort to solve the above-described problems, it is a first feature of an embodiment of the present disclosure to provide a system and method for synthesizing a speech in which the coefficient of a smoothing filter is adaptively changed to minimize a discontinuous distortion.

It is a second feature of an embodiment of the present disclosure to provide a recording medium in which the speech synthesis method is recorded by using a program code executable in a computer.

It is a third feature of an embodiment of the present disclosure to provide an apparatus and method for control of a smoothing filter characteristic in which the characteristic of a smoothing filter is controlled by controlling the coefficient of the smoothing filter in a speech synthesis system.

It is a fourth feature of an embodiment of the present disclosure to provide a recording medium in which the smoothing filter characteristic controlling method is recorded by using a program code executable in a computer.

In order to achieve the first feature, there is provided a speech synthesis system for controlling a discontinuous distortion at the transition portion between concatenated phonemes which are speech units of a synthesized speech using a smoothing technique, comprising:

A discontinuous distortion processing means adapted to predict a discontinuity occurs at the transition portion between concatenated phoneme samples used for a speech synthesis and control the boundary portion between phonemes of a synthesized speech in such a fashion that it is smoothed adaptively to correspond to a degree of the predicted discontinuity.

In order to achieve the first feature, there is provided a speech synthesis system, comprising: a smoothing filter adapted to smooth the discontinuity that occurs at the transition portion between concatenated phonemes of the synthesized speech to correspond to a filter coefficient; a filter characteristics controller adapted to compare a degree of a real discontinuity occurred at the transition portion between the concatenated phonemes of the synthesized speech with a degree of a discontinuity predicted according to the result obtained from a predetermined learning process using the phoneme samples employed for speech synthesis, and then output the compared result as a coefficient selecting signal; and filter coefficient determining means adapted to determine the filter coefficient in response to the coefficient selecting signal so as to allow the smoothing filter to smooth the discontinuous distortion occurred at the transition portion between the concatenated phonemes of the synthesized speech according to the degree of the predicted discontinuity.

In order to achieve the first feature, there is also provided a speech synthesis method for controlling a discontinuous distortion occurred at the transition portion between concatenated phonemes of a synthesized speech using a smoothing technique, comprising the steps of:

(a) comparing a degree of a real discontinuity occurred at the transition portion between the concatenated phonemes of the synthesized speech with a degree of a discontinuity predicted according to the result obtained from a predetermined learning process using concatenated samples of phonemes employed for speech synthesis;

(b) determining a filter coefficient corresponding to the compared result from the step (a) so as to smooth the discontinuous discontinuity occurred at the transition portion between the concatenated phonemes of the synthesized speech according to the degree of the predicted discontinuity; and (c) smoothing a discontinuity occurred at the transition portion between the concatenated phonemes of the synthesized speech to correspond to the determined filter coefficient.

In order to achieve the third feature, there is also provided a smoothing filter characteristics control device for adaptively changing, according to the characteristics of a transition portion between concatenated phonemes which are speech units of a synthesized speech, the characteristics of a smoothing filter used in a speech synthesis system for controlling a discontinuous distortion occurred at the transition portion between the concatenated phonemes: comprising: discontinuity measuring means adapted to obtain, as a real discontinuity degree, a degree of a discontinuity occurred at the transition portion between the concatenated phonemes of the synthesized speech to output the obtained real discontinuity degree; discontinuity predicting means adapted to store a learning of prediction of discontinuity occurred at a transition portion between concatenated phonemes in an actually spoken sound therein and predict a degree of a discontinuity occurred at the transition portion between the concatenated samples of phonemes employed for speech synthesis of the synthesized speech in response to reception of the phoneme samples according to the result of the learning to output the degree of the predicted discontinuity; and a comparator adapted to compare the predicted discontinuity degree ($D_p$) applied thereto from the discontinuity predicting means with the real discontinuity degree ($D_r$) applied thereto from the discontinuity measuring means, and then generate the compared result as a coefficient selecting signal for determining a filter coefficient of the smoothing filter.

To achieve the third feature, there is also provided a smoothing filter characteristics control method for adaptively changing, according to the characteristics of a transition portion between concatenated phonemes which are speech units of a synthesized speech, the characteristics of a smoothing filter used in a speech synthesis system for controlling a discontinuous distortion occurred at the transition portion between the concatenated phonemes: comprising the steps of: (a) learning prediction of a discontinuity occurred at the transition portion between concatenated phonemes in an actually spoken sound using samples of phonemes; (b) obtaining, as a real discontinuity degree, a degree of the discontinuity occurred at the transition portion between the concatenated phonemes of the synthesized speech to output the obtained real discontinuity degree; (c) predicting a degree of a discontinuity occurred at the transition portion between the concatenated samples of phonemes employed for speech synthesis of the synthesized speech according to the result of the learning to obtain the degree of the predicted discontinuity; and (d) comparing the predicted discontinuity degree with the real discontinuity degree, and then determining a filter coefficient of the smoothing filter according to the compared result.

BRIEF DESCRIPTION OF THE DRAWINGS

The above objects and advantages of the present disclosure will become more apparent by describing in detail a preferred embodiment thereof with reference to the attached drawings in which.

DETAILED DESCRIPTION OF THE DISCLOSURE

Hereinafter, a system and method for a speech synthesis using a smoothing filter according to a preferred embodiment of the present disclosure will be in detail described with reference to the accompanying drawings.

Figures 1, 2:
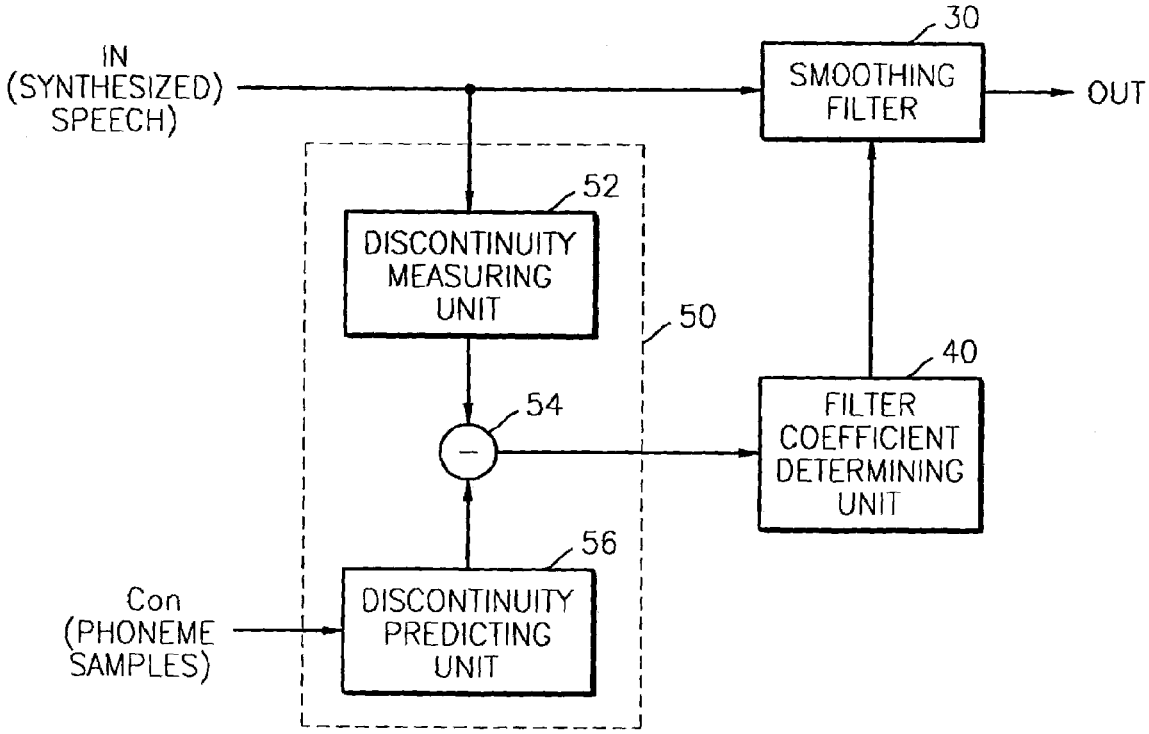
FIG. 1 is a table illustrating the results for distortions in terms of both naturalness and intelligibility when various smoothing methods applicable to a speech coding are applied to a speech synthesis.
FIG. 2 is a block diagram illustrating the construction of a speech synthesis system according to a preferred embodiment of the present disclosure.

FIG. 2 is a block diagram illustrating the construction of a speech synthesis system that is implemented using a smoothing filter according to a preferred embodiment of the present disclosure.

Referring to FIG. 2, there is shown the speech synthesis system including a discontinuous distortion processing section having a filter characteristics controller 50, a smoothing filter 30 and a filter coefficient determining unit 40.

The filter characteristics controller 50 controls characteristics of the smoothing filter 30 by controlling a filter coefficient thereof. More specifically, the filter characteristics controller 50 compares a degree of a real discontinuity at the transition portion between concatenated phonemes of synthesized speech (IN) with a degree of a discontinuity predicted by learned context information, and then outputs the compared result as a coefficient selecting signal (R) to the filter coefficient determining unit 40. As shown in FIG. 2, the filter characteristics controller 50 includes a discontinuity measuring unit 52, a comparator 54 and a discontinuity predicting unit 56.

The discontinuity measuring unit 52 measures a degree of a real discontinuity at the transition portion between the concatenated phonemes of the synthesized speech (IN).

The discontinuity predicting unit 56 predicts a degree of a discontinuity of a speech to be synthesized using the samples of phonemes (i.e., Context information, Con) employed for speech synthesis of the synthesized speech (IN). At this time, the discontinuity predicting unit 56 can predict the degree of the discontinuity of the speech to be synthesized using Classification and Regression Tree (hereinafter, referred to as "CART") scheme, and the CART scheme is formed through a predetermined learning process. This will be in detail described hereinafter with reference to FIGS. 3 and 4.

The comparator 54 obtains a ratio of the degree of the predicted discontinuity applied thereto from the discontinuity predicting unit 56 to the degree of the real discontinuity applied thereto from the discontinuity measuring unit 52, and then outputs the resultant value as the coefficient selecting signal (R) to the filter coefficient determining unit 40.

Also, the filter coefficient determining unit 40 determines a filter coefficient ($\alpha$) representing a degree of a smoothing in response to the coefficient selecting signal (R) so as to allow the smoothing filter 30 to smooth the real discontinuity that occurs at the transition portion between the concatenated phonemes of the synthesized speech (IN) according to the degree of the predicted discontinuity.

The smoothing filter 30 is smoothing a discontinuity at the transition portion between the concatenated phonemes of the synthesized speech to correspond to the filter coefficient ($\alpha$) determined by the filter coefficient determining unit 40. At this time, the characteristic of the smoothing filter 30 can be defined by the following [Expression 1]:

$$W'_p=\alpha W_p+(1-\alpha)W_n$$

$$W'_n=(1-\alpha)W_p+\alpha W_n \qquad \text{[Expression 1]}$$

where $W'_n$ and $W'_p$ denote speech waveforms smoothed by the smoothing filter 30, respectively, $W_p$ denotes a speech waveform of a first pitch cycle of speech units (phonemes) situated on the left side with respect to a transition portion between concatenated phonemes in which to measure a degree of a discontinuity, and $W_n$ denotes a speech waveform of a last pitch cycle of speech units situated on the right side with respect to the transition portion. It can be seen from [Expression 1] that the closer the filter coefficient ($\alpha$) approximates to 1, the weaker a smoothing degree of the smoothing filter 30 becomes, whereas the closer the filter coefficient ($\alpha$) approximates to 0, the stronger the smoothing degree of the smoothing filter becomes.

Figure 3:
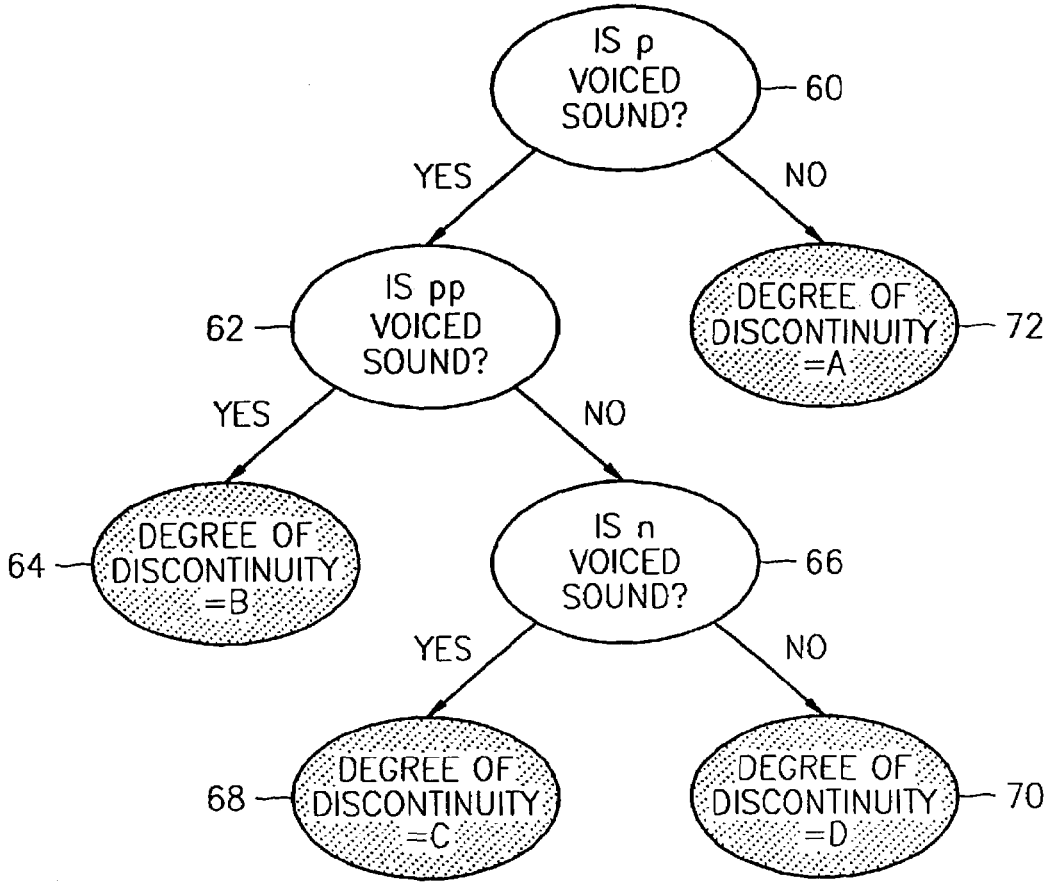
FIG. 3 is a diagrammatical view illustrating a discontinuity predictive tree for forming the result of a learning through the use of the Classification and Regression Tree (hereinafter, referred to as "CART") scheme in a discontinuity predicting unit 56 shown in FIG. 2.

FIG. 3 is a diagrammatical view illustrating a discontinuity predictive tree formed by the result of a learning through the use of the Classification and Regression Tree (hereinafter, referred to as "CART") scheme in a discontinuity predicting unit 56 shown in FIG. 2 according to a preferred embodiment of the present disclosure.

Referring to FIG. 3, for the sake of convenience of explanation, although the variables used in the prediction of a discontinuity have been illustrated with respect to whether or not each of the concatenated phonemes is a voiced sound, it is possible to take various phoneme characteristics such as information about each phoneme itself, syllable constituent components of the phoneme, etc., into consideration for prediction of the discontinuity.

Figure 4:
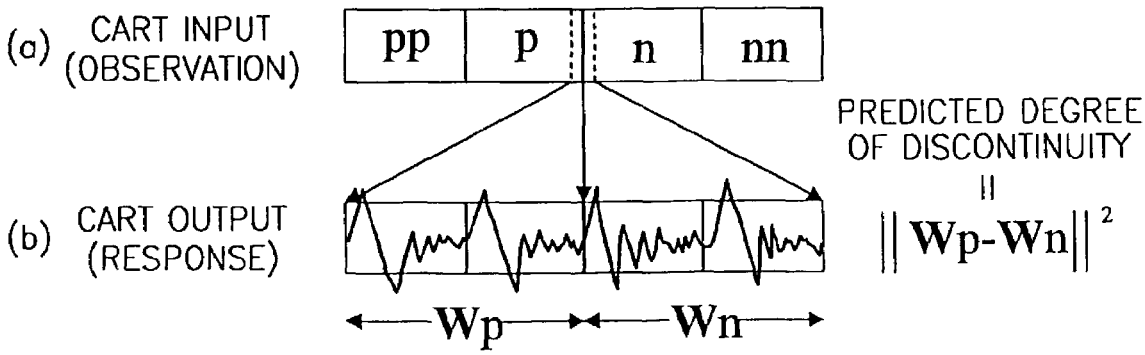
FIG. 4 is a graphical view illustrating a CART input which consists of near four phoneme samples centering on a transition portion between concatenated phonemes, and a CART output for the CART shown in FIG. 3.

FIG. 4 is a graphical view illustrating a CART input which consists of near four phoneme samples centering on a transition portion between concatenated phonemes, and a CART output for the CART shown in FIG. 3.

Referring to FIG. 4, the number of the phoneme samples used as speech units for the prediction of a discontinuity is 4. That is, the phoneme samples include quadraphones, i.e., a total of four phonemes consisting of a first pair of phonemes (p, pp) and a second pair of phonemes (n, nn) that are oppositely arranged on the left and right sides with respect to a transition portion between concatenated phonemes in which to predict a discontinuity. Also, the first and second pairs of phonemes (p, pp) (n, nn) are concatenated. In the meantime, a correlation and a variance reduction ratio are used as performance factors of the CART scheme employed for the prediction of the discontinuity. At this time, research associated with the CART has suggested that when the correlation value obtained exceeds 0.75 as compared to a nearly standardized performance scale, a discontinuity predicting unit employing the CART is feasible. For example, there are used a total of 428,507 data samples which consist of 342,899 learning data needed for CART learning and 85,608 test data for an estimation of performance. At this time, in case of using four phonemes concatenated with a transition portion being situated between concatenated phonemes upon the prediction of a discontinuity, the correlation value has 0.757 for the learning data, and 0.733 for the test data, respectively. Thus, it can be seen from the correlation result that since these two values approximate 0.75, the prediction of a discontinuity employing the CART is useful. In the meantime, in the case of using two phonemes concatenated with a transition portion being situated between the concatenated phonemes upon the prediction of a discontinuity, the correlation value has 0.685 for the learning data, and 0.681 for the test data, respectively. Thus, it can be seen from the correlation result that the case of using the two concatenated phonemes exhibits poorer performance than that of using the four phonemes does. Also, in case of using six phonemes concatenated with a transition portion being situated between the concatenated phonemes upon the prediction of a discontinuity, the correlation value has 0.750 for the learning data, and 0.727 for the test data, respectively. Thus, it can be seen from the foregoing correlation results that upon the prediction of a discontinuity using the CART, performance of its prediction is the best when the number of phonemes used as a CART input is 4.

When four samples of concatenated phonemes (pp, p, n, nn) as shown in FIG. 4(*a*) are inputted to a discontinuity predictive tree type process routine using the CART scheme as shown in FIG. 3, a speech waveform $W_p$ of the last pitch cycle of speech units or phonemes arranged on the left side with respect to a transition portion between concatenated speech units, and a speech waveform $W_n$ of the first pitch cycle of speech units or phonemes arranged on the right side with respect to the transition portion are outputted as shown in FIG. 4(*b*). Degree of a discontinuity can be predicted using the speech waveforms $W_p$ and $W_n$ outputted from the CART like the following [Expression 2]:

$$D_p = \|W_p - W_n\|^2 \quad \text{[Expression 2]}$$

As shown in FIG. 3, the CART is designed to determine a discontinuity predicting value in response to a question with a hierarchical structure. A question described in each circle is determined according to an input value of the CART. Further, the discontinuity predicting value is determined at terminal nodes 64, 72, 68 and 70, which are no further questions. First, at node 60, it is determined whether or not the left-hand phoneme p closest to a transition portion speech between concatenated phonemes in which to predict a degree of discontinuity is a voiced sound. If it is determined at node 60 that the left-hand phoneme p is not a voiced sound, the program proceeds to node 72 in which it is predicted by the above [Expression 2] that a degree of discontinuity will be A. On the other hand, if it is determined at node 60 that the left-hand phoneme p is a voiced sound, the program proceeds to node 62 where it is determined whether or not the left-hand phoneme pp farthest from the transition portion is a voiced sound. If it is determined at node 62 that the left-hand phoneme pp is a voiced sound, the program proceeds to node 64 where it is predicted by the above [Expression 2] that a degree of discontinuity will be B. On the other hand, if it is determined at node 62 that the left-hand phoneme pp is not a voiced sound, the program proceeds to node 66 where it is determined whether or not the right-hand phoneme n closest to the transition portion is a voiced sound. According to the result of the determination at the node 66, the program proceeds to node 66 where it is predicted that the degree of discontinuity will be C or to node 70 where it is predicted that the discontinuity will be D.

Now, an operation of the speech synthesis system according to the present disclosure will be in detail described hereinafter with reference to FIGS. 2 to 4.

First, the filter characteristics controller 50 obtains a degree ($D_r$) of a real discontinuity at a transition portion between concatenated phonemes of synthesized speech (IN) through the discontinuity measuring unit 52, and then obtains a degree ($D_p$) of discontinuity predicted according to the result obtained from the CART learning process using the phoneme samples (Con) employed for speech synthesis of the synthesized speech (IN) through the discontinuity predicting unit 56. Then, the filter characteristics controller 50 obtains a ratio (R) of the predicted discontinuity degree ($D_p$) to the real discontinuity degree ($D_r$) by the following [Expression 3], and outputs the obtained ratio as a coefficient selecting signal (R) to the filter coefficient determining unit 40:

$$R = \frac{D_p}{D_r}. \quad \text{[Expression 3]}$$

In this case, the discontinuity predicting unit 56 stores a result of the CART learning process predicting a discontinuity at a transition portion between the concatenated phonemes through context information generated by a real human voice. When the phoneme samples (Con) employed for speech synthesis are input, the discontinuity predicting unit 56 obtains the predicted discontinuity degree ($D_p$) according to the result of the CART learning. Thus, the predicted discontinuity degree ($D_p$) is a predicted discontinuity when a real human pronounces the context information.

The filter coefficient determining unit 40 determines a filer coefficient ($\alpha$) in response to the coefficient signal (R) through the following [Expression 4] and outputs the determined filer coefficient ($\alpha$) to the smoothing filter 30:

$$\alpha = \frac{1}{2}(\sqrt{R} + 1). \quad \text{[Expression 4]}$$

Referring to the above [Expression 4], when R is greater than 1, that is, the real discontinuity degree ($D_r$) is lower than the predicted discontinuity degree ($D_p$), the smoothing filter 30 decreases the filter coefficient ($\alpha$) so that a smoothing process is performed more weakly (see the above [Expression 1]). The fact that the predicted discontinuity degree ($D_p$) is higher than the real discontinuity degree ($D_r$) means that a degree of discontinuity is high in an actually spoken sound, whereas it appears to be low in a synthesized speech. Namely, in the case where the discontinuity degree in the actually spoken sound is higher than that in the synthesized speech, the smoothing filter 30 performs a smoothing of the synthesized speech (IN) more weakly so that the synthesized speech (IN) maintains the discontinuity degree in the actually spoken sound. On the other hand, when R is smaller than 1, that is, the real discontinuity degree ($D_r$) is higher than the predicted discontinuity degree ($D_p$), the smoothing filter 30 increases the filter coefficient ($\alpha$) so that a smoothing process is performed more strongly (see the above [Expression 1]). The fact that the predicted discontinuity degree ($D_p$) is lower than the real discontinuity degree ($D_r$) means that a degree of discontinuity is low in the actually spoken sound, whereas it appears to be high in the synthesized speech. Namely, in the case where the discontinuity degree in the actually spoken sound is lower than that in the synthesized speech, the smoothing filter 30 performs a smoothing of the synthesized speech (IN) more strongly so that the synthesized speech (IN) maintains the discontinuity degree in the actually spoken sound.

As described above, the smoothing filter 30 smoothes the synthesized speech (IN) so that the discontinuity degree of synthesized speech (IN) follows the predicted discontinuity degree ($D_p$) according to the filter coefficient ($\alpha$) changed adaptively to correspond to a ratio of the predicted discontinuity degree ($D_p$) to the real discontinuity degree ($D_r$). That is, since a discontinuity at a transition portion between concatenated phonemes of the synthesized speech (IN) is adaptively smoothed to follow the discontinuity in the actually spoken sound, the synthesized speech can be approximated more closely to a real human voice.

Also, the present disclosure can be implemented with a program code executable in a computer in a recording medium readable by the computer. The recording medium includes all types of recording apparatus for storing data that are read by a computer system. Examples of the recording medium include a ROM, a RAM, a CD-ROM, a-magnetic tape, a floppy disk, an optical data storage device, etc. Further, the recording medium may be implemented in a form of a carrier wave (for example, a transmission through the Internet). The recording medium readable by the computer may be dispersed in a network connected computer system so that a program code readable by the computer is stored in the recording medium and executed by the computer in a dispersion scheme.

While this invention has been particularly shown and described with reference to preferred embodiments thereof, it will be understood by those skilled in the art that various modifications, permutations and equivalents may be made without departing from the spirit of the invention. Also, it should be understood that the phraseology or terminology employed herein is for the purpose of description and not of limitation. The scope of the invention, therefore, is to be determined solely by the appended claims.

What is claimed is:

1. A speech synthesis system for controlling a discontinuous distortion that occurs at a transition portion between concatenated phonemes, which are speech units of synthesized speech, using a smoothing technique, comprising:

a discontinuous distortion processing means for predicting a discontinuity at a transition portion between concatenated samples of phonemes used for speech synthesis through a predetermined learning process, and for controlling speech synthesis so that a discontinuity at the transition portion between the concatenated phonemes of the synthesized speech is smoothed adaptively to correspond to a degree of the predicted discontinuity determined according to a result of the predetermined learning process.

2. The speech synthesis system as claimed in claim 1, wherein the predetermined learning process is performed by a CART (Classification and Regression Tree) scheme.

3. A speech synthesis system comprising:

a smoothing filter for smoothing a discontinuity that occurs at a transition portion between concatenated phonemes of synthesized speech employing a filter coefficient $\alpha$;

a filter characteristics controller for comparing a degree of a real discontinuity at the transition portion between the concatenated phonemes of the synthesized speech with a degree of a discontinuity predicted according to a result obtained from a predetermined learning process using phoneme samples employed for speech synthesis, and outputting the comparison result as a coefficient selecting signal R; and filter coefficient determining means for determining the filter coefficient $\alpha$ in response to the coefficient selecting signal R so as to allow the smoothing filter to smooth discontinuous distortion at the transition portion between the concatenated phonemes of the synthesized speech according to the degree of the predicted discontinuity.

4. The speech synthesis system as claimed in claim 3, wherein the predetermined learning process is performed by a CART (Classification and Regression Tree) scheme.

5. The speech synthesis system as claimed in claim 4, wherein the phoneme samples used for the prediction of the discontinuity comprises quadraphones (four phonemes) consisting of two phonemes before a transition portion between concatenated phonemes and two phonemes after the transition portion.

6. The speech synthesis system as claimed in claim 3, wherein the coefficient selecting signal R is obtained by the following formula:

$$R = \frac{D_p}{D_r}$$

where $D_p$ is a degree of the predicted discontinuity, and $D_r$ is a degree of the real discontinuity of the synthesized speech.

7. The speech synthesis system as claimed in claim 3, wherein the filter coefficient determining means determines the filter coefficient $\alpha$ by the following formula in response to the coefficient selecting signal R:

$$\alpha = \frac{1}{2}\sqrt{R} + 1\Big).$$

8. A speech synthesis method for controlling a discontinuous distortion that occurs at a transition portion between concatenated phonemes of synthesized speech using a smoothing technique, comprising the steps of:

(a) comparing a degree of a real discontinuity at the transition portion between the concatenated phonemes of the synthesized speech with a degree of a discontinuity predicted according to a result obtained from a predetermined learning process using concatenated samples of phonemes employed for speech synthesis;

(b) determining a filter coefficient corresponding to the compared result from the step (a) so as to smooth the discontinuity at the transition portion between the concatenated phonemes of the synthesized speech according to the degree of the predicted discontinuity; and (c) smoothing a discontinuity at the transition portion between the concatenated phonemes of the synthesized speech to correspond to the determined filter coefficient.

9. A computer readable memory media encoded with executable instructions representing a computer program that can cause a computer to carry out the speech synthesis method as claimed in claim 8.

10. A smoothing filter characteristics control device for adaptively changing, according to the characteristics of a transition portion between concatenated phonemes, which are speech units of synthesized speech, the characteristics of a smoothing filter used in a speech synthesis system for controlling a discontinuous distortion that occurs at the transition portion, the device comprising:

discontinuity measuring means which obtains a degree of a discontinuity at the transition portion between the concatenated phonemes of the synthesized speech as a real discontinuity degree and outputs the obtained real discontinuity degree;

discontinuity predicting means which stores a result of a learning process predicting discontinuity at a transition portion between concatenated phonemes in actually spoken sounds using samples of phonemes, predicts a degree of a discontinuity at a transition portion between input concatenated samples of phonemes employed for speech synthesis of the synthesized speech according to the result of the learning, and outputs the degree of the predicted discontinuity; and a comparator which compares the predicted discontinuity degree Dp applied thereto from the discontinuity predicting means with the real discontinuity degree Dr applied thereto from the discontinuity measuring means, and generates the compared result as a coefficient selecting signal for determining a filter coefficient of the smoothing filter.

11. The smoothing filter characteristics control device as claimed in claim 10, wherein the learning in the discontinuity predicting means is performed by a CART (Classification and Regression Tree) scheme.

12. The smoothing filter characteristics control device as claimed in claim 11, wherein the phoneme samples used for the prediction of the discontinuity comprise quadraphones (four phonemes) consisting of two phonemes before a transition portion between concatenated phonemes in which to predict a discontinuity and two phonemes after the transition portion.

13. The smoothing filter characteristics control device as claimed in claim 12, wherein the predicted discontinuity degree $D_p$ and the real discontinuity degree $D_r$ are obtained by the following formulas;

$$D_p = \|W_p - W_n\|^2$$

$$D_p = \|W'_p - W'_n\|^2$$

wherein $W_p$ is a speech waveform of a last pitch cycle of speech units arranged on a left side with respect to a transition portion between concatenated speech units in which to measure a degree of a discontinuity in the synthesized speech, $W_n$ is a speech waveform of a first pitch cycle of speech units arranged on a right side with respect to the transition portion in which to measure the discontinuity degree, $W'_p$ is a speech waveform of the last pitch cycle of speech units arranged on the left side with respect to a transition portion between concatenated speech units in which to predict a degree of a discontinuity in the actually spoken sounds, and $W'_n$ is a speech waveform of the first pitch cycle of speech units arranged on the right side with respect to the transition portion in which to predict the discontinuity degree.

14. The smoothing filter characteristics control device as claimed in claim 10, wherein the comparator generates a coefficient selecting signal R obtained by the following formula:

$$R = \frac{D_p}{D_r}.$$

15. The smoothing filter characteristics control device as claimed in claim 10, wherein the filter coefficient α is determined by the following formula in response to the coefficient selecting signal R:

$$\alpha = \frac{1}{2}\sqrt{R} + 1\Big).$$

16. A smoothing filter characteristics control method for adaptively changing, according to characteristics of a transition portion between concatenated phonemes, which are speech units of synthesized speech, characteristics of a smoothing filter used in a speech synthesis system for controlling a discontinuous distortion that occurs at the transition portion, the method comprising the steps of:

(a) storing a result of a learning process predicting a discontinuity at a transition portion between concatenated phonemes in actually spoken sounds using samples of phonemes;

(b) obtaining a real degree of the discontinuity at the transition portion between the concatenated phonemes of the synthesized speech and outputting the obtained real discontinuity degree;

(c) predicting a degree of a discontinuity at a transition portion between input concatenated samples of phonemes employed for speech synthesis of the synthesized speech according to the result of the learning and outputting the predicted discontinuity degree; and (d) determining a filter coefficient of the smoothing filter according to the predicted discontinuity degree and the real discontinuity degree.

17. A smoothing filter characteristics control method as claimed in claim 16 wherein the step (d) further comprises the steps of:

(d1) obtaining a ratio R of the predicted discontinuity degree to the real discontinuity degree; and (d2) determining the filter coefficient α by the following formula:

$$\alpha = \frac{1}{2}\sqrt{R} + 1\Big).$$

18. A computer readable memory media encoded with executable instructions representing a computer program that can cause a computer to carry out the smoothing filter characteristics control method as claimed in claim 16.

* * * * *